US007234256B2

(12) United States Patent
Grasmann

(10) Patent No.: US 7,234,256 B2
(45) Date of Patent: Jun. 26, 2007

(54) SETTING DEVICE

(76) Inventor: Josef Grasmann, Weiβenbach 18, A-3242 Texing, Texing (AT)

( * ) Notice: Subject to any disclaimer, the term of this patent is extended or adjusted under 35 U.S.C. 154(b) by 258 days.

(21) Appl. No.: 10/975,271

(22) Filed: Oct. 28, 2004

(65) Prior Publication Data

US 2005/0091891 A1 May 5, 2005

(30) Foreign Application Priority Data

Oct. 31, 2003 (AT) ..... A 1736/2003

(51) Int. Cl.
*G09F 9/30* (2006.01)
*G09F 9/37* (2006.01)

(52) U.S. Cl. ..... 40/447; 40/446

(58) Field of Classification Search ..... 40/446, 40/447, 583; 400/127, 129, 134
See application file for complete search history.

(56) References Cited

U.S. PATENT DOCUMENTS 909,444 A * 1/1909 Newell ..... 40/447
4,186,394 A * 1/1980 Bobak et al. ..... 40/513
6,944,984 B1 * 9/2005 Grasmann ..... 40/447

* cited by examiner

*Primary Examiner*—Robert J. Sandy
(74) *Attorney, Agent, or Firm*—McKee, Voorhees & Sease, P.L.C.

(57) ABSTRACT

An apparatus for displacing slide elements (3) in an apparatus for displaying characters, which consists of a basic part (1) comprising openings (3) for receiving the slide elements (3) and a visible surface (1*a*) and a reverse side opposite of the same, with the slide elements (3) being arranged in a displaceable manner from a first position to a second position in which the face surface (5) is arranged in the basic part (1) at a distance behind the visible surface (1*a*) and is substantially not visible. Two handle strips (7, 8) are provided which can be pressed against each other and on which there are arranged setting templates (16, 17) which are adjustable relative to each other and comprise positioning pins (34) which can be inserted into openings (2) of the basic part (1), and ) which can be introduced from both sides into the openings (2).

19 Claims, 17 Drawing Sheets

SETTING DEVICE

The present invention relates to an apparatus for displacing slide elements in an apparatus for displaying characters, preferably on a price label. It consists of a basic part comprising openings for receiving the slide elements and a visible surface and a reverse side opposite of the same. The slide elements are arranged in a displaceable manner from a first position in which the face sides of the slide elements are visible from the visible surface of the basic part to a second position in which the face surfaces are arranged in the basic part at a distance behind the visible surface and are substantially not visible. The openings for displaying each character are preferably arranged in a form of a matrix.

A similar apparatus is already known from EP 1232491 A1. In this case however the apparatus disclosed there has a more complex setting mechanism and a more complex setting method. The apparatus disclosed in EP 1232491 A1 calibrates in a first method step the position of the slide elements, such that all slide elements which are provided for displaying a character are displaced to one end of the openings receiving the slide elements. The slide elements are displaced in a second method step to such position in which the desired character can be read on the visible surface. This procedure requires that positioning pins displacing the slide elements need to be introduced first from one side into the openings of the basic part in order to perform the calibration. Other positioning pins need to be introduced from the other side into the openings in order to push the slide elements to their required end position. This time-offset introduction of the positioning pins into the opening of the basic part requires a complex motion mechanism of the apparatus. Moreover, the precise time adjustment is very important because the calibration first of the slide elements whose openings are covered by the calibrating positioning pins it is not possible to first introduce the positioning pins into the openings which produce the displacement of the slide element according to the character to be displayed.

It is the object of the present invention to avoid these disadvantages and to provide an apparatus of the kind mentioned above which is simple in its configuration and allows to perform a more convenient and quicker setting of the characters to be displayed on the basic part.

This is achieved in accordance with the invention by the characterizing features of claim 1.

As a result of the precise allocation of positioning pins to each slide element for each character to be displayed, a separation of the positioning pins can be made in the respect that only the part of the positioning pins which is required for displaying the desired character and which push the slide elements to the visible surface of the basic part is arranged on a setting template and the other part of the positioning pins which is responsible for displacing the slide elements in the direction of the reverse side opposite of the visible surface is arranged at the opposite side of the setting template. In this way, the positioning pins can be introduced substantially simultaneously form both sides into the openings of the basic part guiding the slide element, leading to a substantial simplification in the movement mechanism of the apparatus. It is therefore sufficient to press the handle strips against each other. In their initial position they are preferably aligned in a V-shaped manner relative to each other and are connected with each other via a spring element. By pressing the handle strips together, they are aligned parallel with respect to each other and the positioning pins moved with the handle strips can be introduced simultaneously into the openings of the basic part. The setting thus occurs more quickly than in the already known apparatus. Positioning pins that need not be displaced due to a former illustrated character are not displaced in the setting apparatus in accordance with the invention.

The arrangement of the positioning pins occurs in the setting templates which are held in the handle strips which according to an embodiment of the invention in accordance with the characterizing feature of claim 2 are joined with each other and are fixed in their position with respect to each other. Groups of positioning pins are arranged in sections on the setting templates. Groups of positioning pins arranged on mutually joined setting templates are allocated with respect to each other in directly opposite sections and are provided for simultaneous introduction of different sides into the openings of the basic part.

According to a preferred embodiment of the invention as described in the characterizing features of claim 3, two mutually associated groups of positioning pins comprise the number of positioning pins which corresponds to the number of openings for displaying a character in the basic part. As a result, one of the mutually associated groups can form a positive image of the character to be displayed on the setting template and the other of the associated groups can form an inverse representation of the character on the setting template. Both groups which are introduced simultaneously into the openings of the basic part of mutually opposite sides produce the alignment of the slide elements on the visible surface according to the character to be displayed.

As a result of the characterizing features of claims 4 and 5 it is possible to fasten the setting templates in a displaceable way on the handle strips.

As a result of the characterizing features of claim 6, setting templates arranged mutually opposite on different handle strips can be joined to each other and be fixed in their position relative to each other. There is thus also the definition of mutually associated groups of positioning pins which are introduced substantially simultaneously into the openings of the basic part.

As a result of the characterizing feature of claim 7, the basic part can be held between the handle strips in a position in which the positioning pins can be introduced into its openings.

The characterizing features of claim 8 describe a preferred embodiment of the holding element.

The distance between webs which are arranged in parallel with respect to each other corresponds according to the characterizing part of claim 9 substantially to the width of the setting templates, so that the same can be displaced along the handle strips despite the holding element. Positioning positions which are associated with each other in the holding element receiving the basic part can be brought into position for the introduction into its openings.

The webs forming the holding element and the receiving means each comprise breakthroughs in accordance with claim 10 to 12, which breakthroughs, in combination, form an outwardly accessible cuboid chamber within the holding element into which a basic part can be pushed. The cross section of the chamber is formed by the flush aligned breakthroughs of the webs. The longitudinal section is formed by the breakthrough which is arranged at a right angle thereto in the receiving means.

Claims 13 to 15 describe a preferably realized ejector for the basic part 1. After the alignment of the slide element in the basic part, the same can be removed again rapidly from the apparatus in accordance with the invention, as a result of which the same will become free for use in the next basic part.

As a result of the characterizing features of claim 16, the holding element and the setting templates form a precisely matched unit which allow a precise mutual positioning.

Claims 17 to 19 describe alternative embodiments of the setting templates.

There is now a detailed description of the invention shown in the drawings, wherein.

Figure 1:
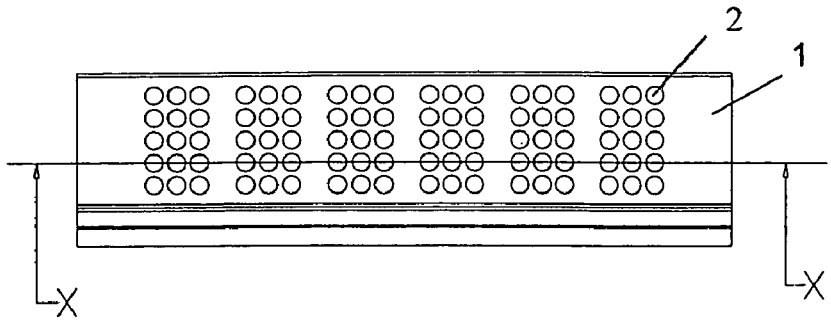
FIG. 1 shows a front view of a basic part (price label)
Figure 6:
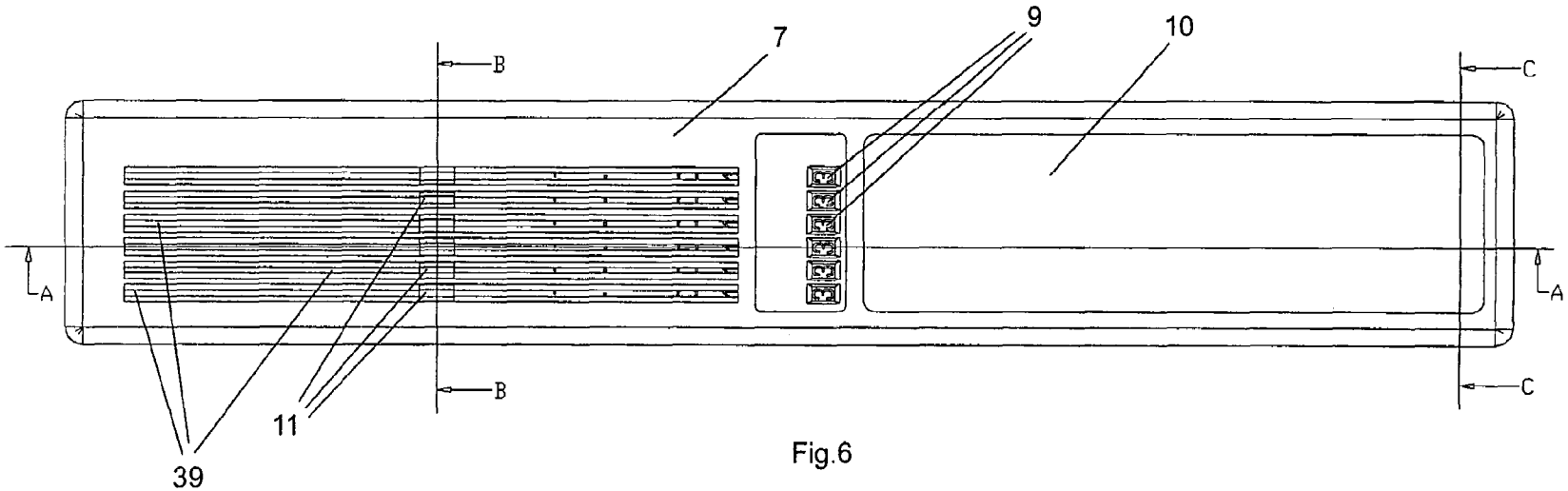
FIG. 6 shows a top view of an apparatus in accordance with the invention.
Figure 7:
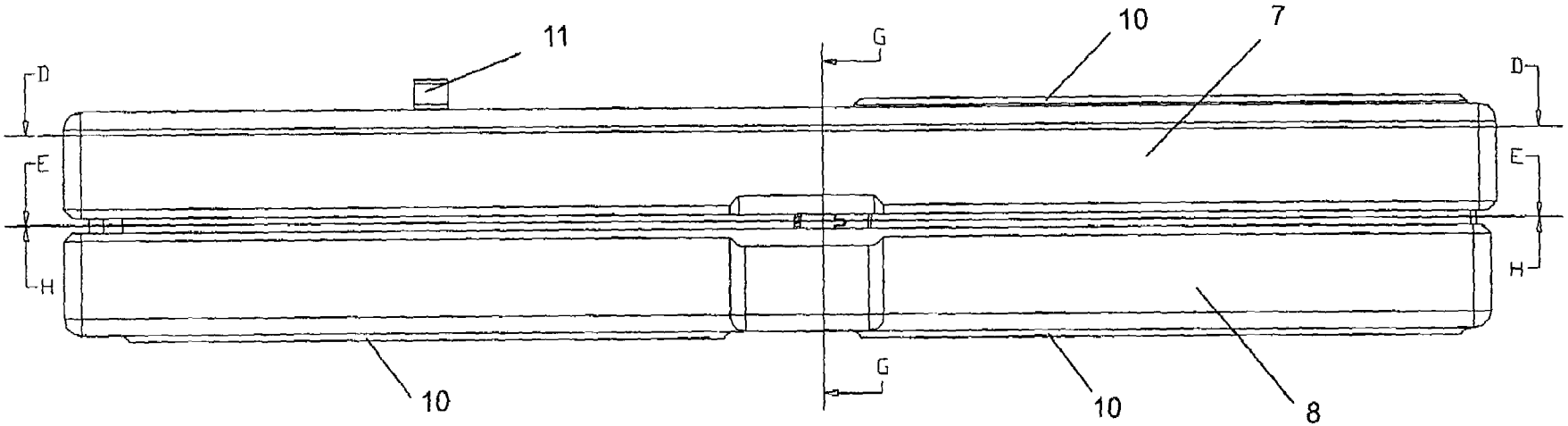
FIG. 7 shows a side view of an apparatus in accordance with the invention in a compressed position.
Figure 8:
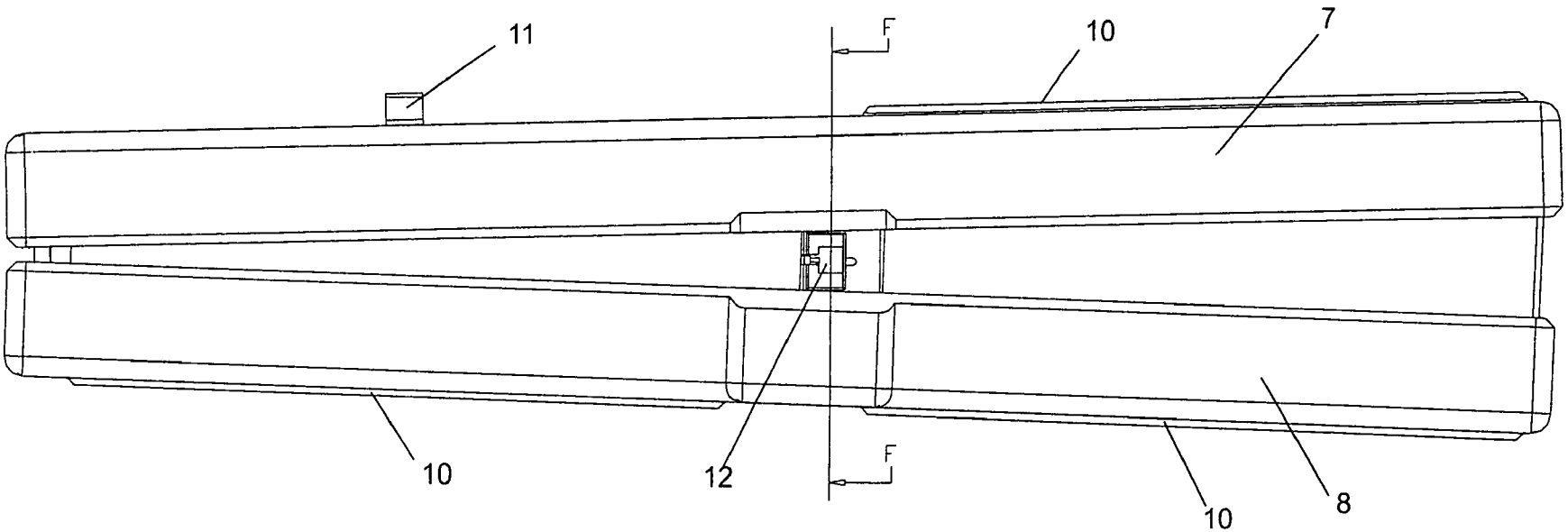
FIG. 8 shows a side view of an apparatus in accordance with the invention without a basic part in the initial position.
Figure 9:
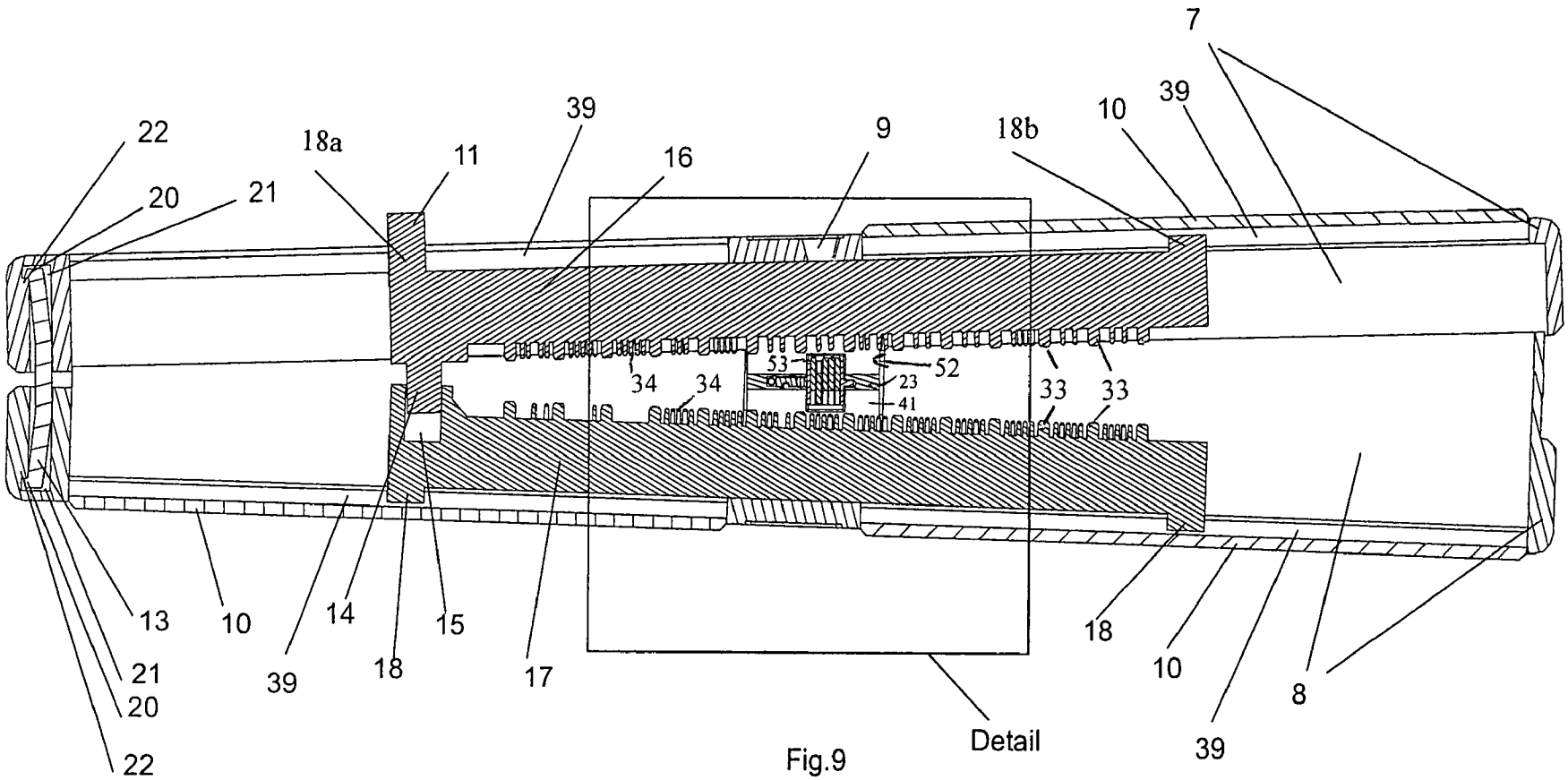
FIG. 9 shows a sectional view of an apparatus in accordance with the invention along the line AA of FIG. 6 in the initial position with inserted basic part.
Figure 9A:
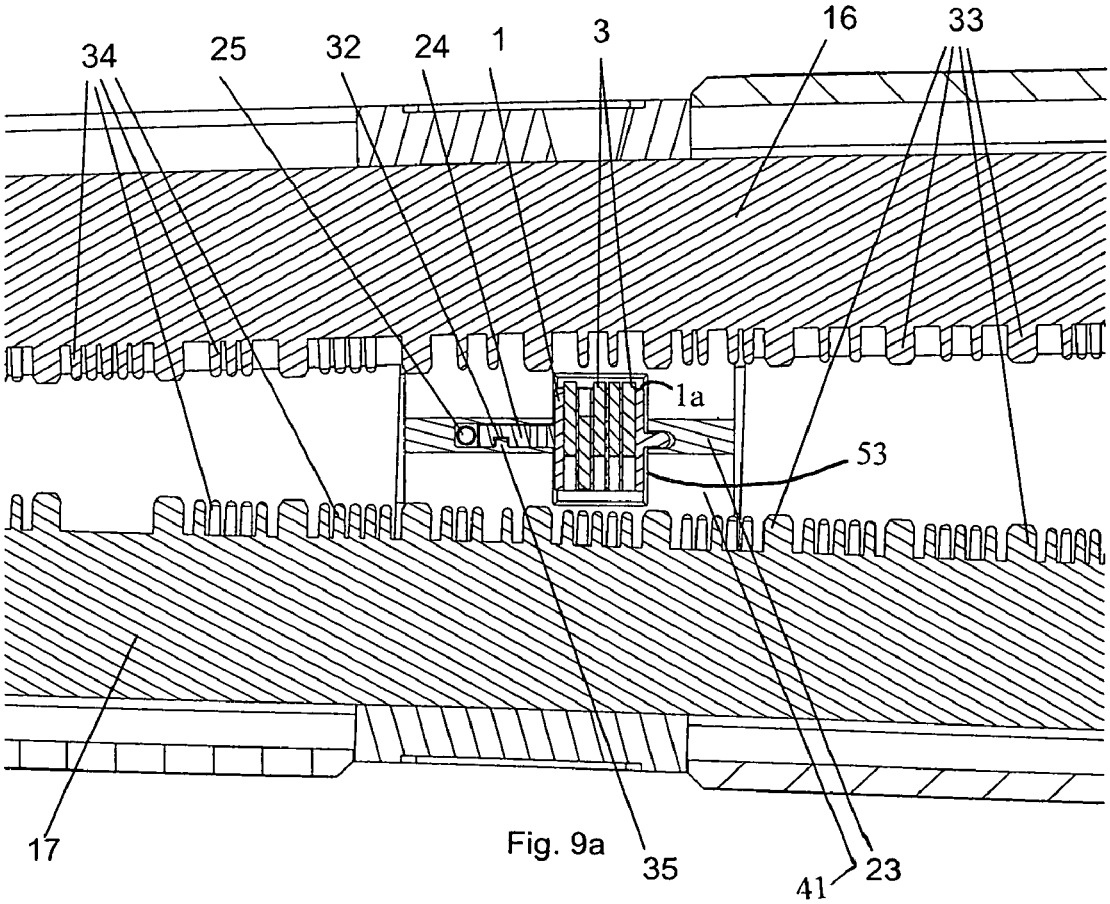
Figure 10A:
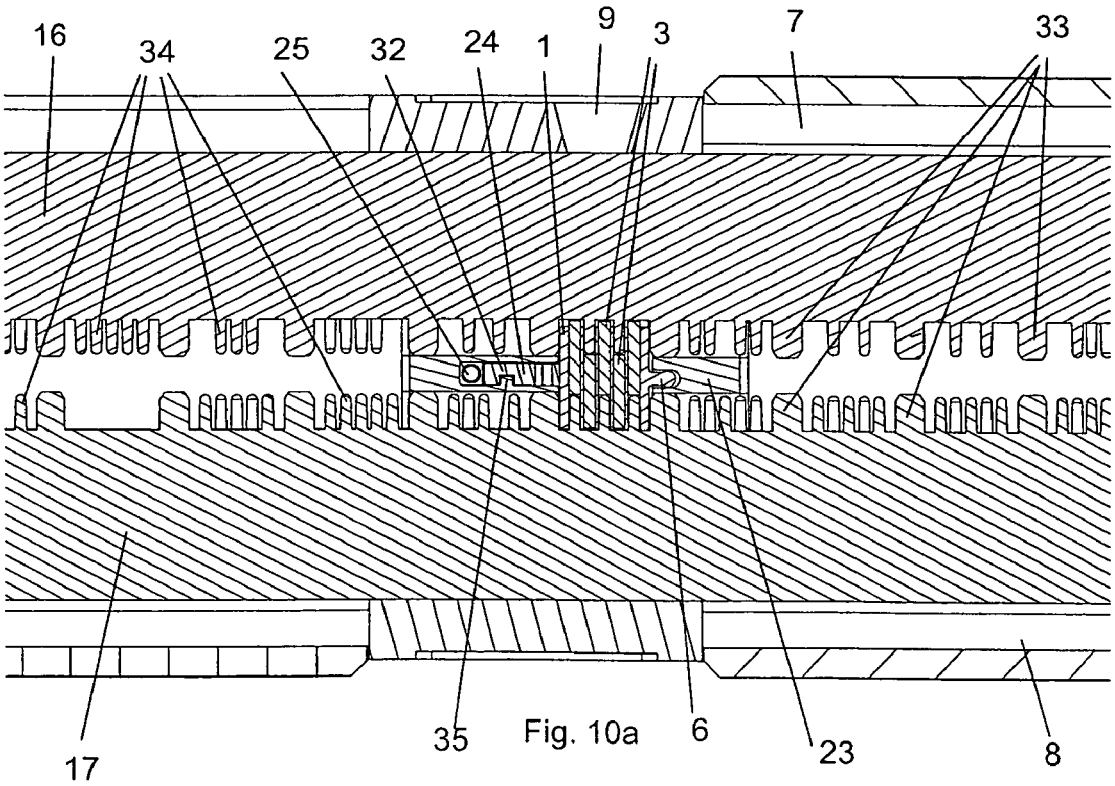
Figure 10:
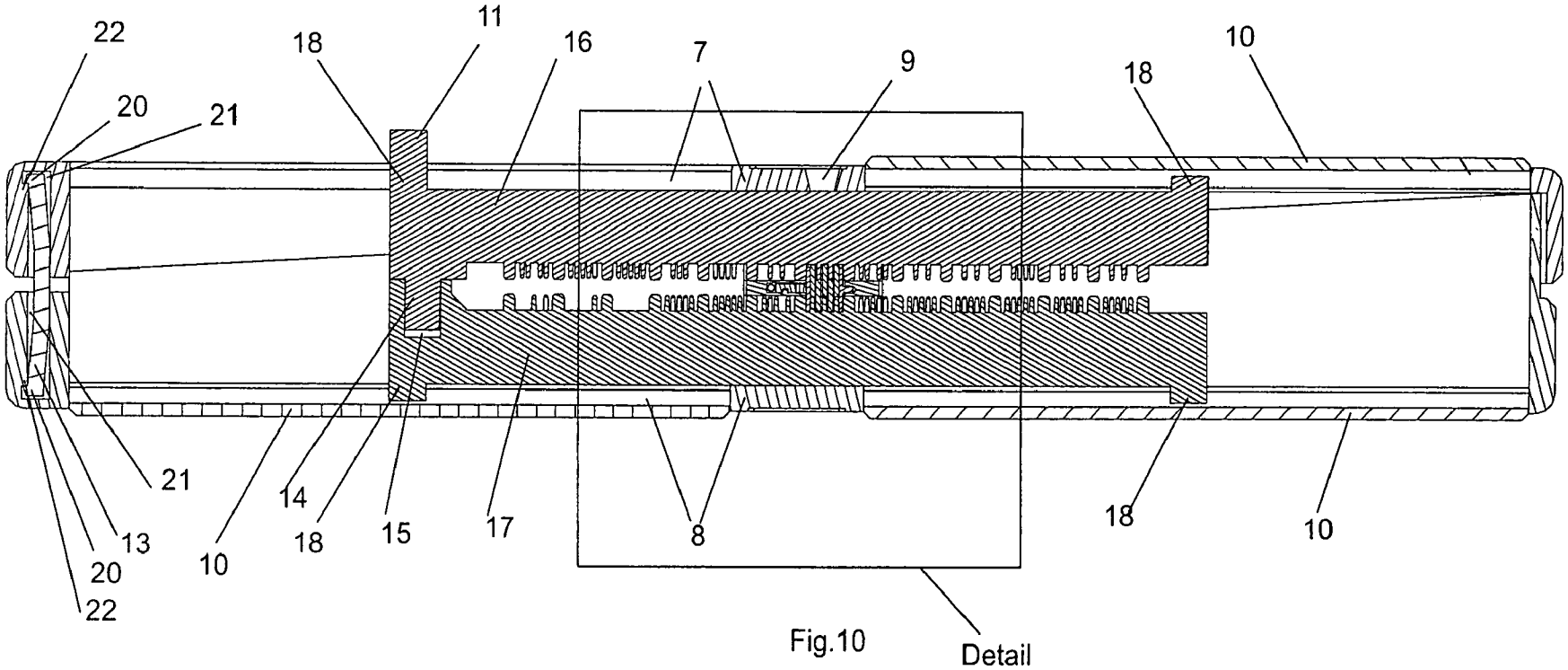
Figure 11:
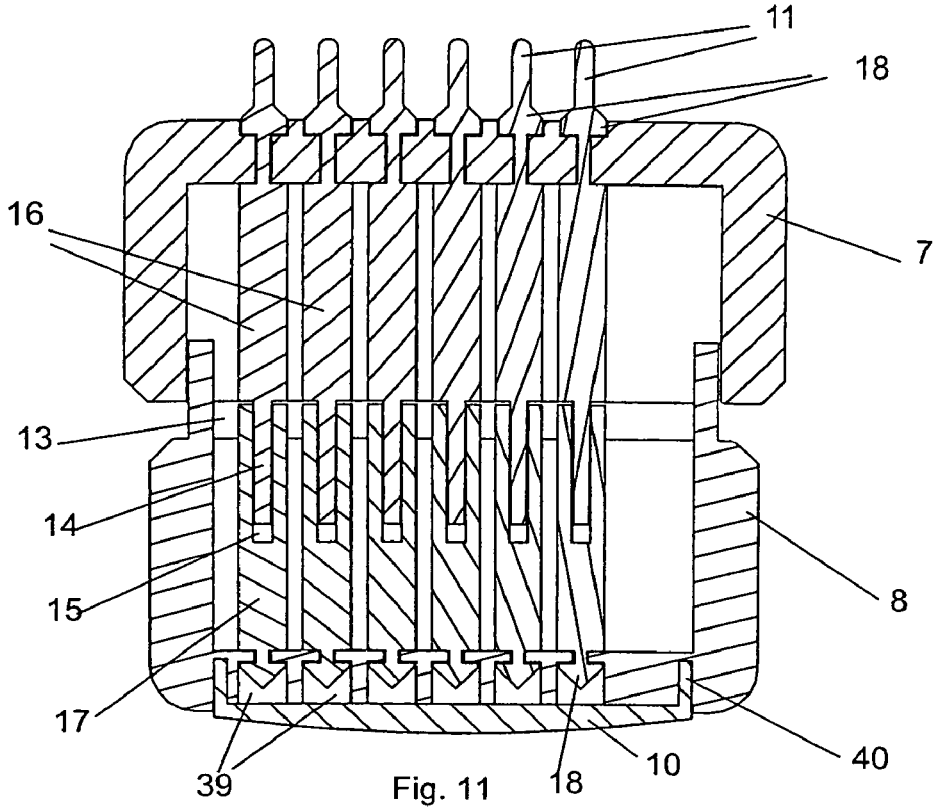
Figure 12:
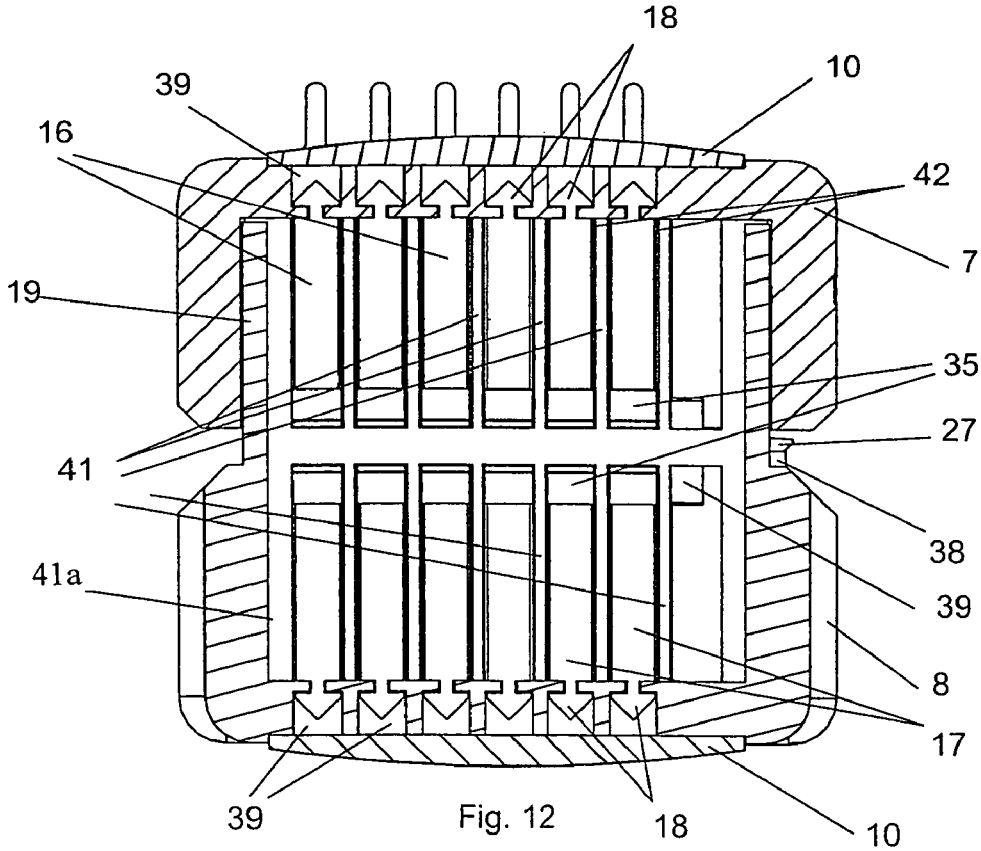
Figure 13:
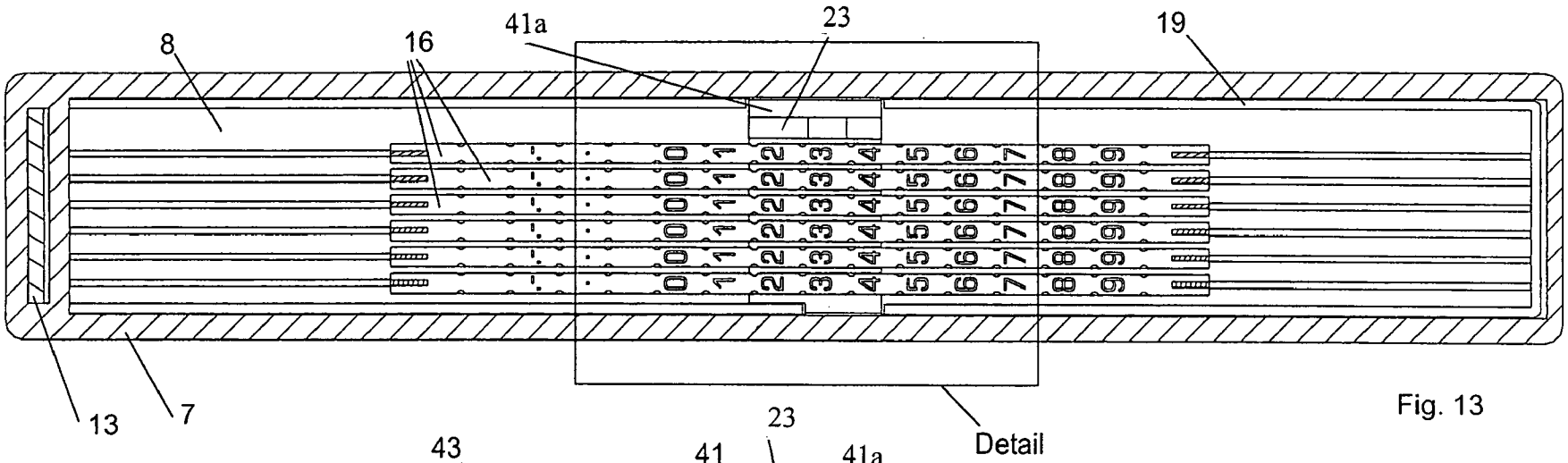
Figure 13A:
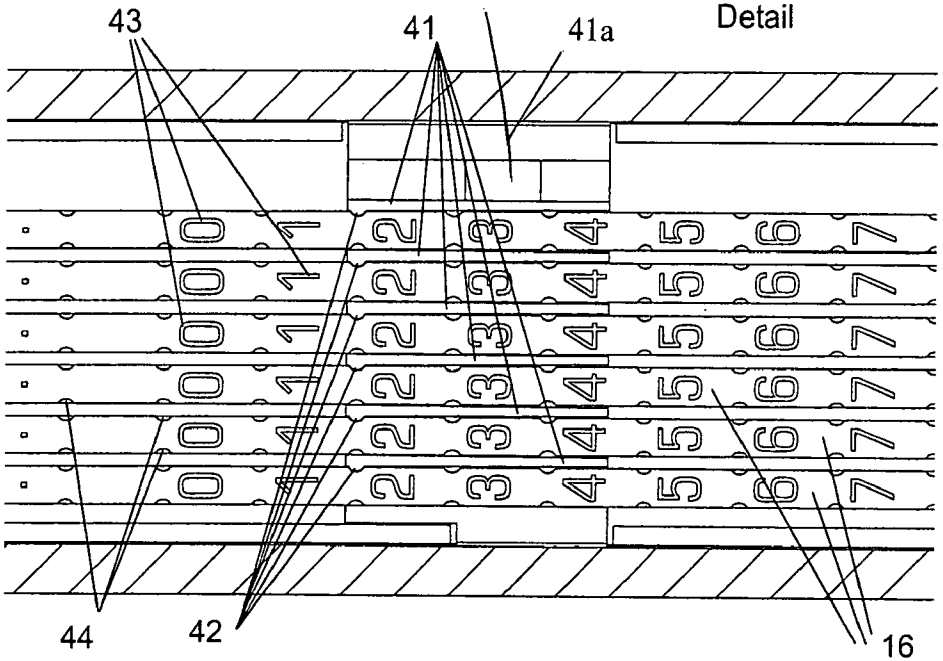
Figure 14B:
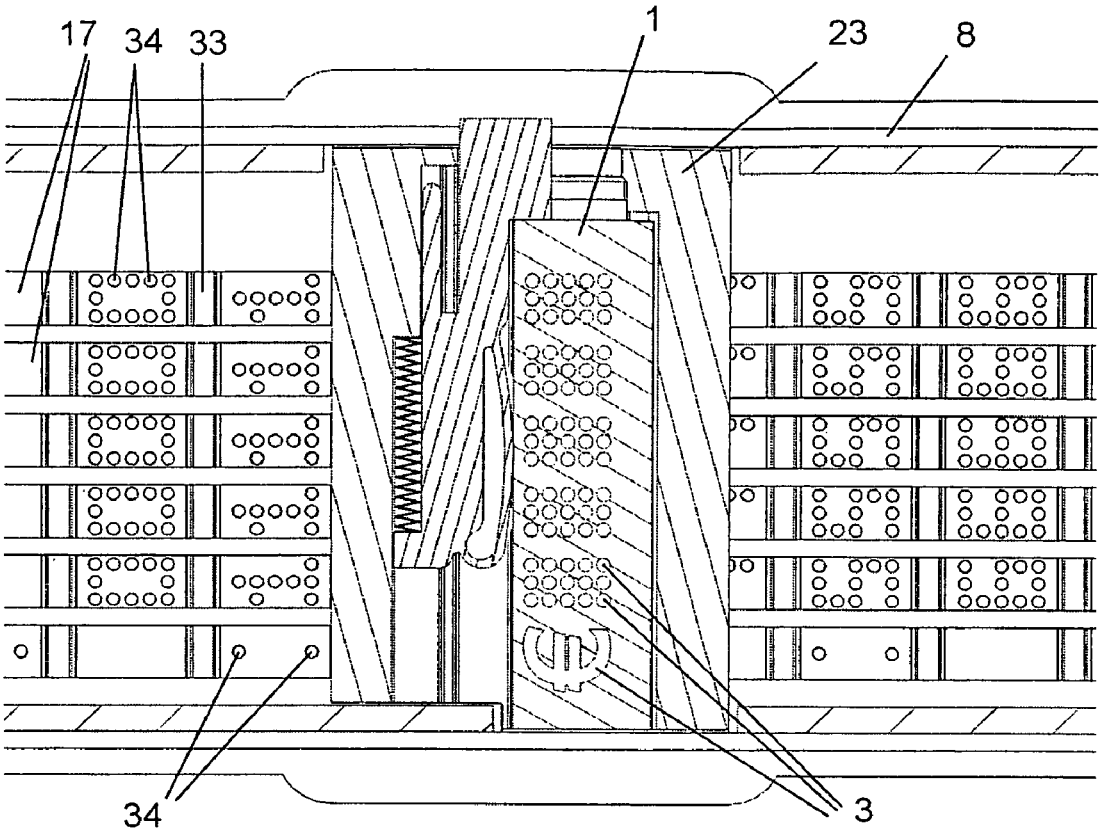
Figure 13B:
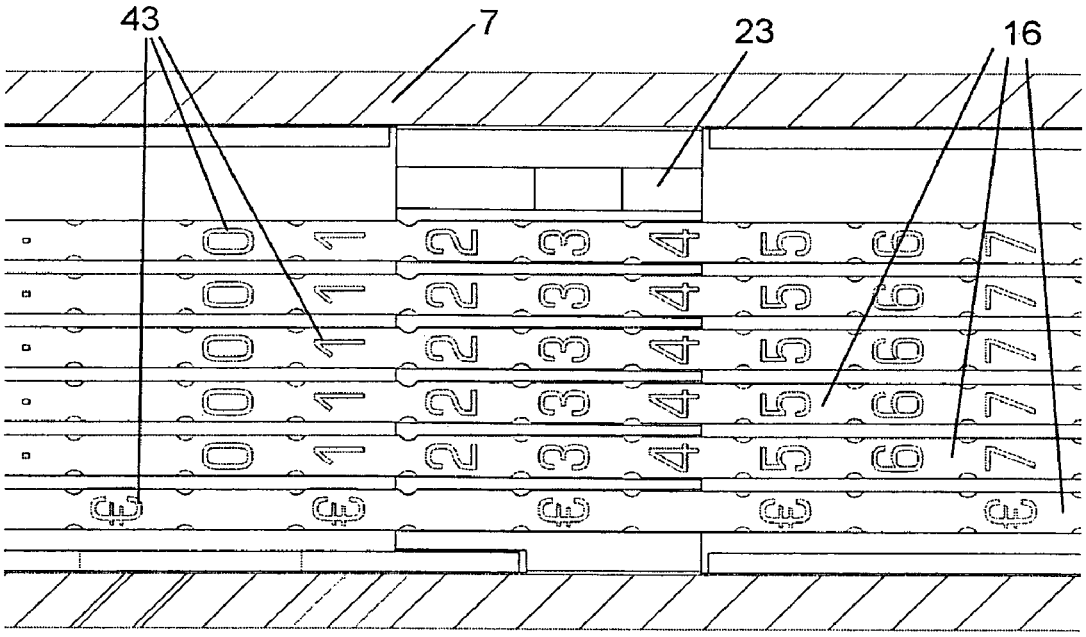
Figure 14:
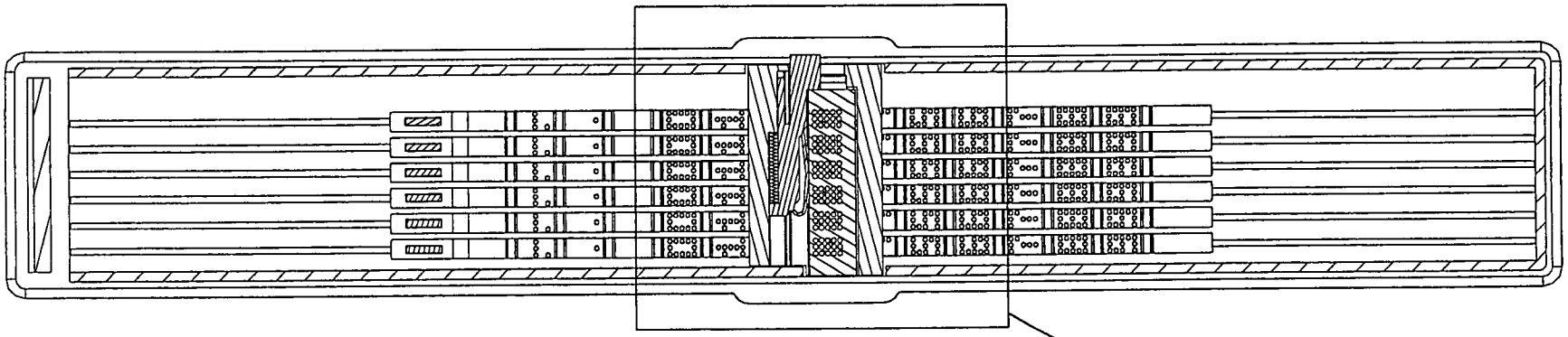
Figure 15:
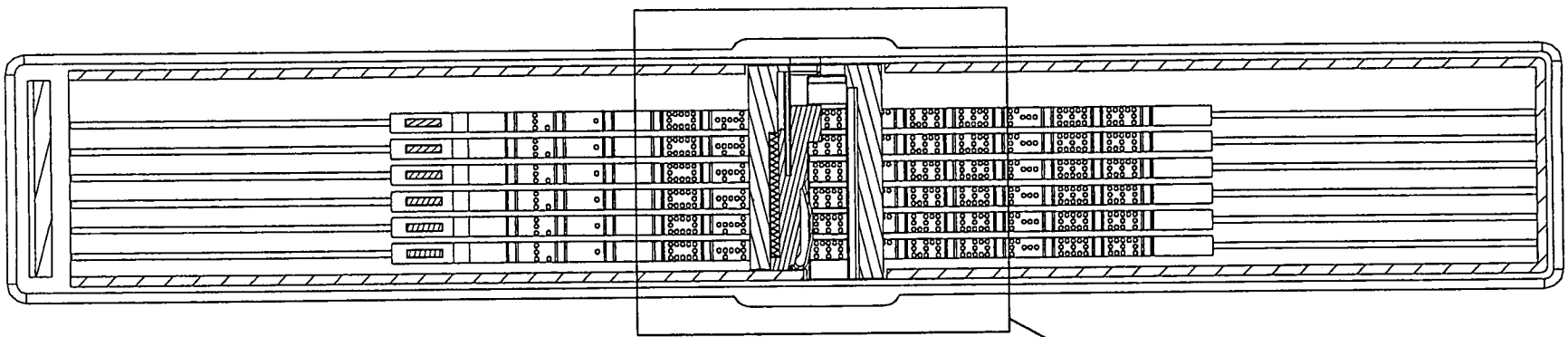
Figure 14A:
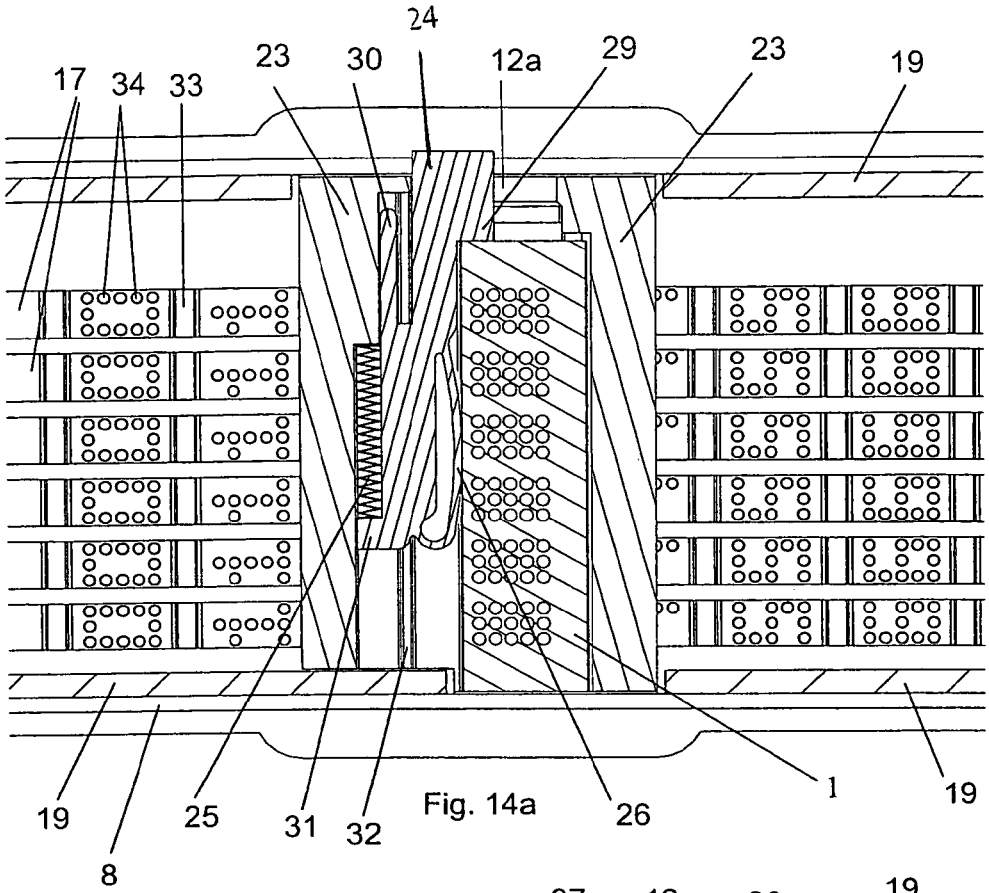
Figure 15A:
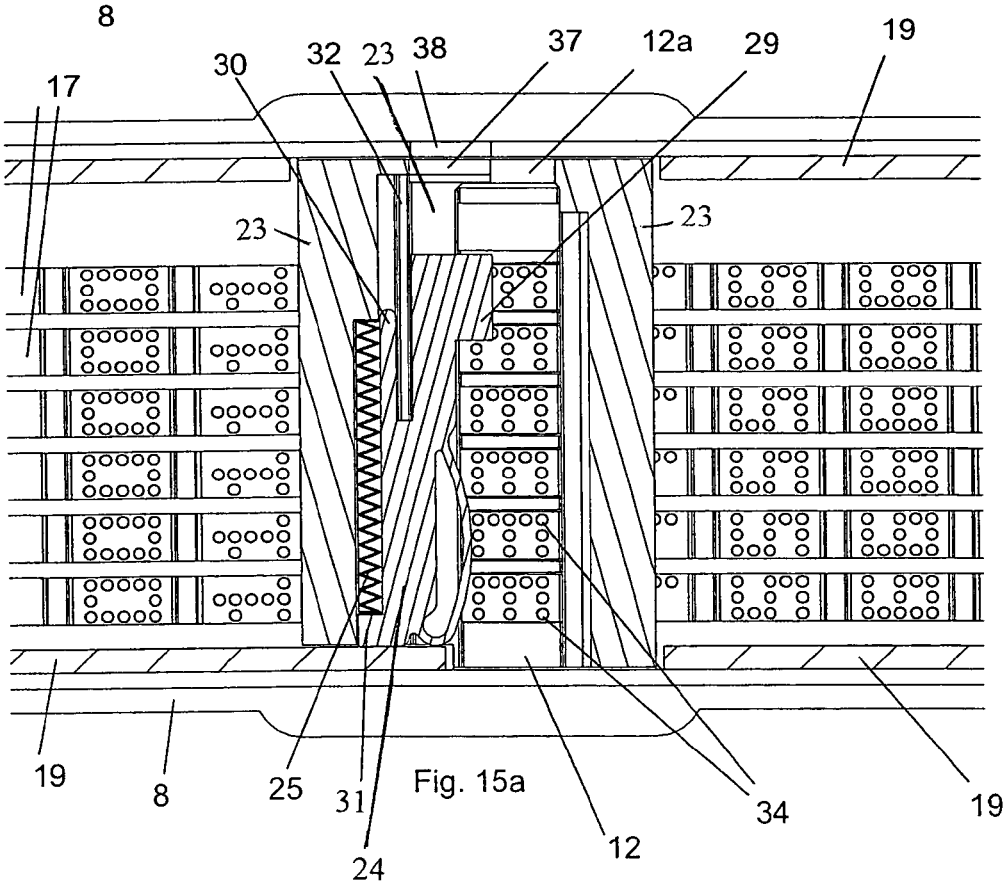
Figure 15B:
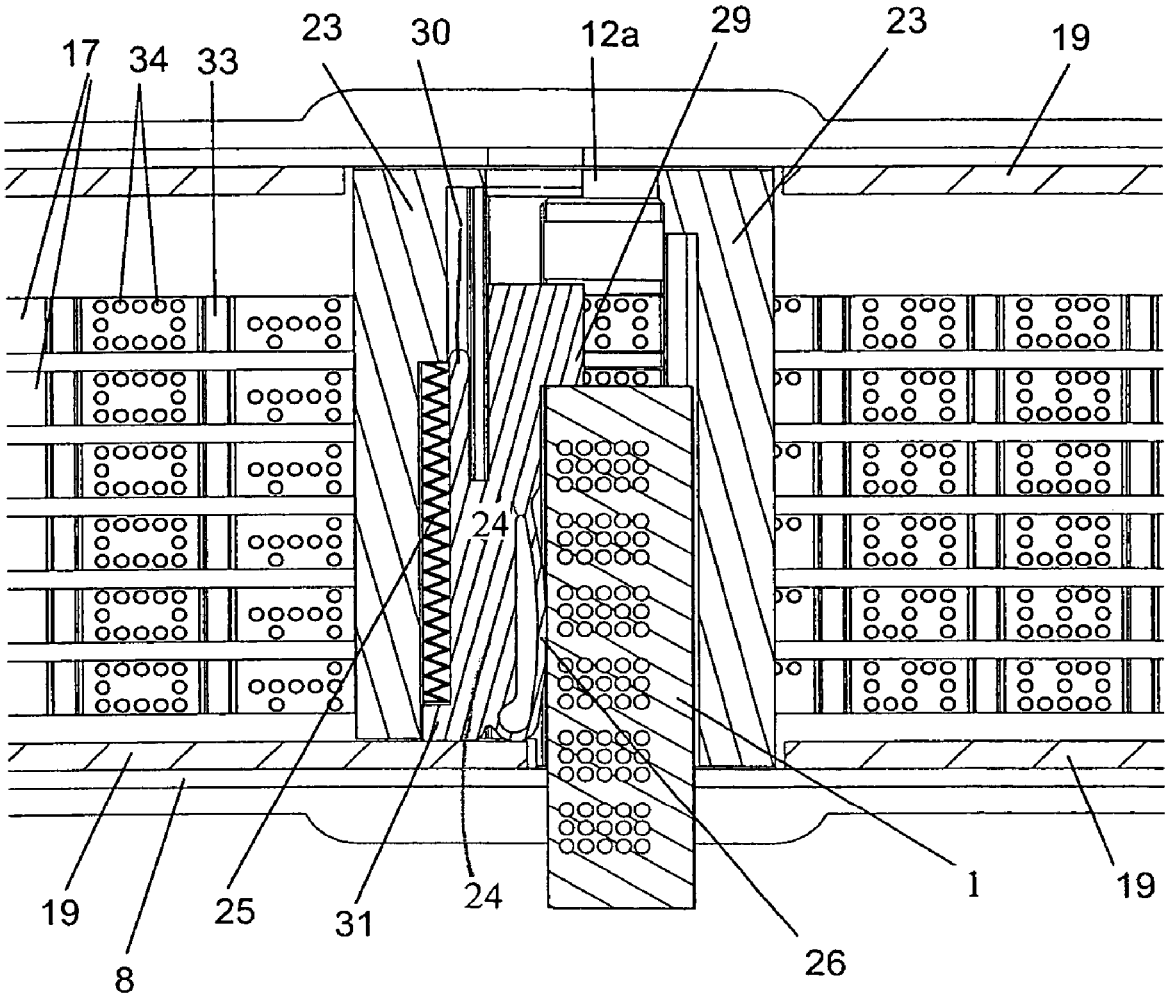
Figure 16:
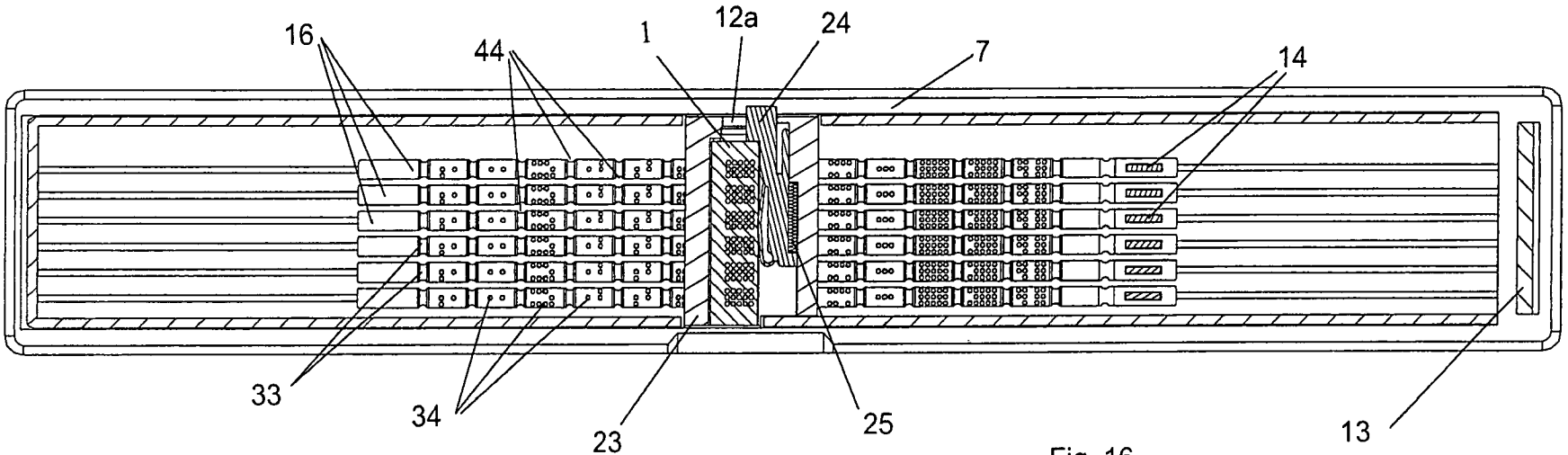
Figure 16A:
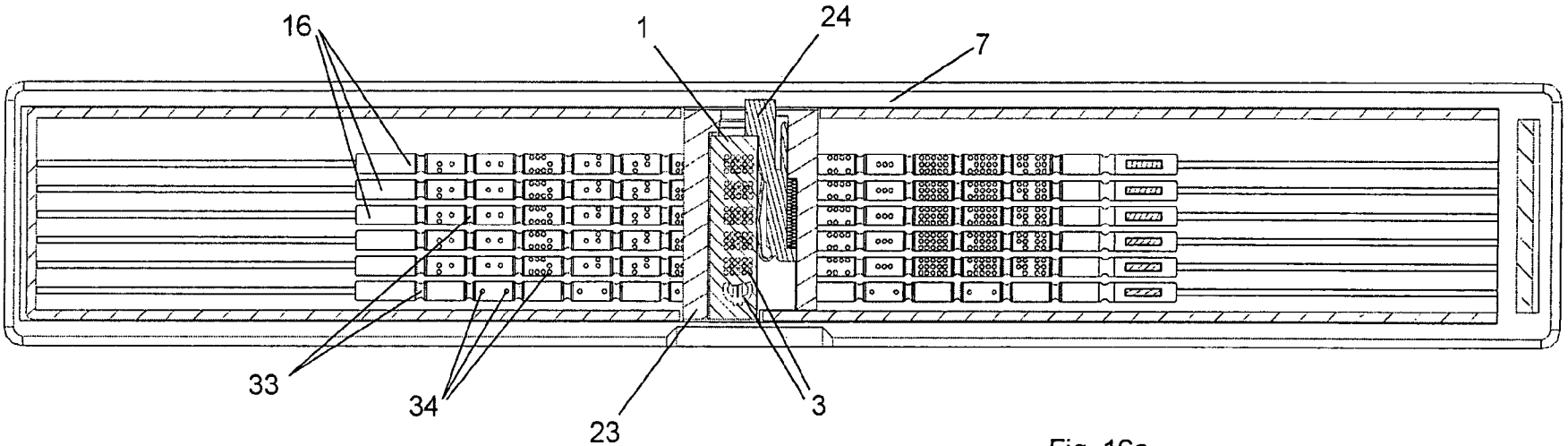
Figure 17:
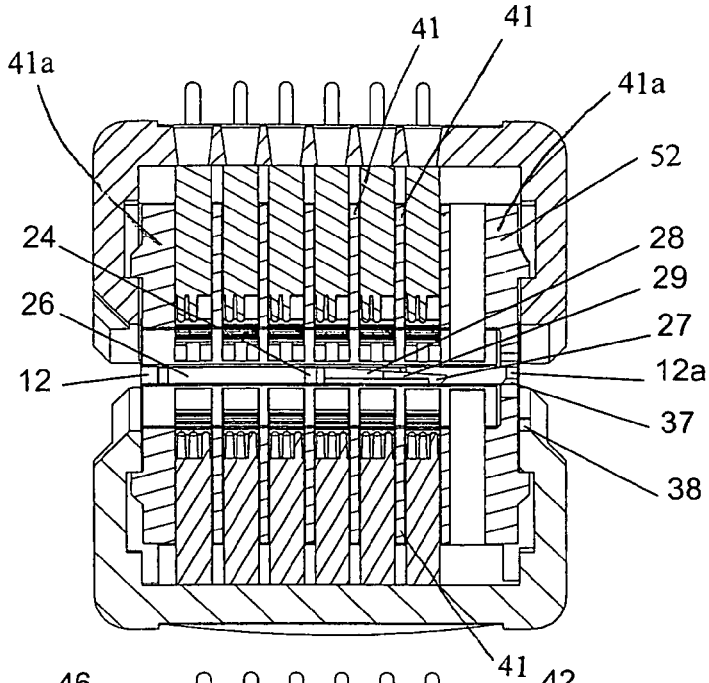
Figure 18:
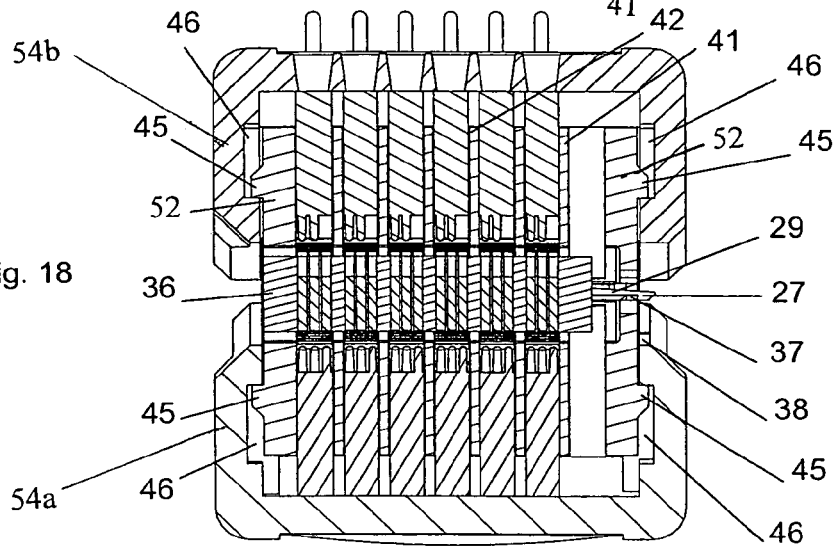
Figure 19:
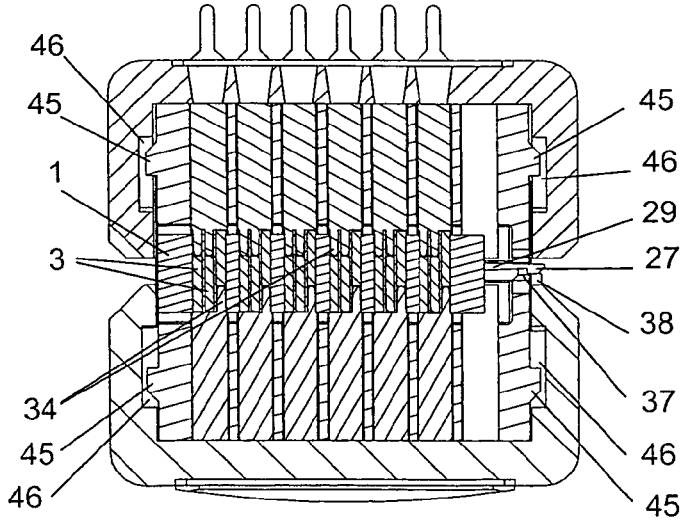
Figure 20:
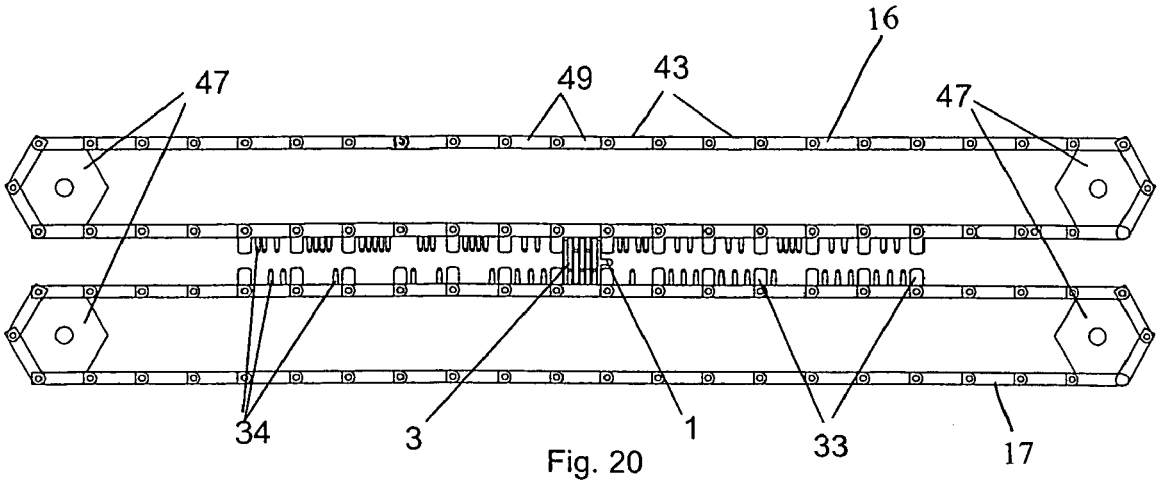
Figure 21:
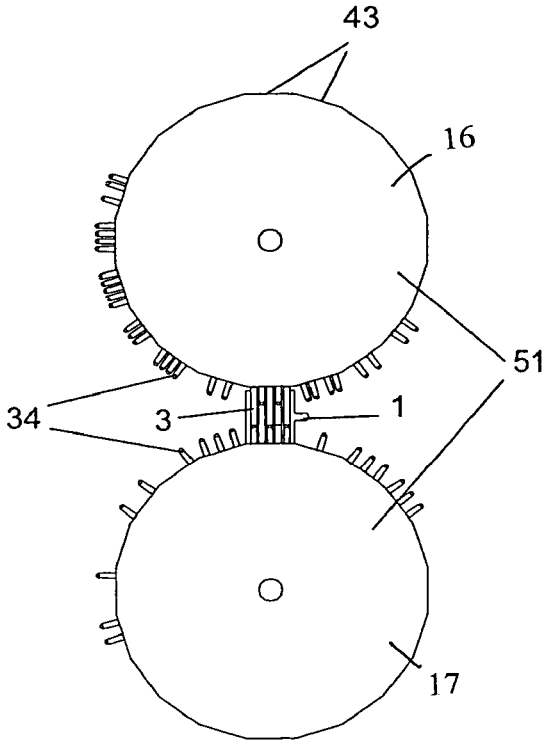
Figure 22:
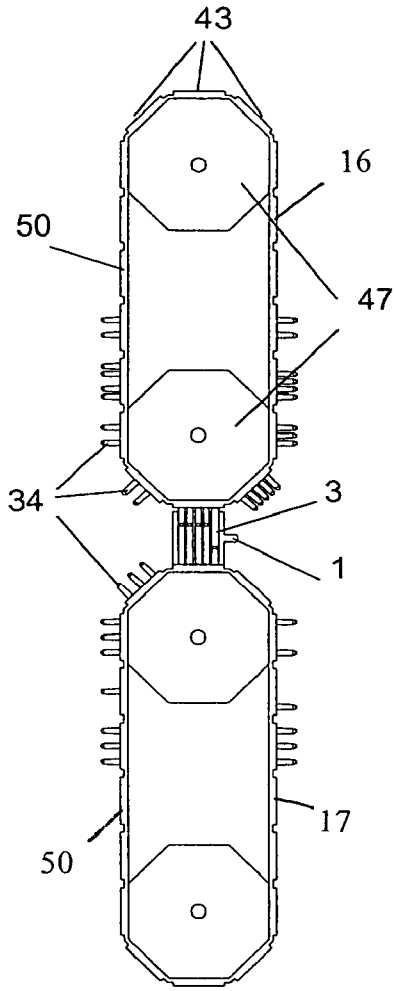

FIG. 9*a* shows the detail of FIG. 9;

FIG. 10 shows a sectional view of an apparatus in accordance with the invention along the line AA of FIG. 6 in a compressed position with inserted basic part;

FIG. 10*a* shows the detail of FIG. 10;

FIG. 11 shows a sectional view along the line BB of FIG. 6;

FIG. 12 shows a sectional view along the line CC of FIG. 6;

FIG. 13 shows a sectional view along the line DD of FIG. 7;

FIG. 13*a* shows a detail of FIG. 13;

FIG. 13*b* shows a detail of FIG. 13 with a larger slide element;

FIG. 14 shows a sectional view along the line EE of FIG. 7 with a basic part;

FIG. 14*a* shows a detail of FIG. 14;

FIG. 14*b* shows a detail of FIG. 14*a* with a larger slide element;

FIG. 15 shows a sectional view along the line EE of FIG. 7 without the basic part;

FIG. 15*a* shows a detail of FIG. 15 with an inserted basic part;

FIG. 15*b* shows a detail of FIG. 15 with an ejected basic part;

FIG. 16 shows a sectional view along the line HH of FIG. 7;

FIG. 16*a* shows a sectional view along the line HH of FIG. 7 with a basic part with larger slide element;

FIG. 17 shows a sectional view along the line FF of FIG. 8 without basic part;

FIG. 18 shows a sectional view along the line FF of FIG. 8 with basic part;

FIG. 19 shows a sectional view along the line GG of FIG. 7 in a compressed position;

FIG. 20 shows an alternative embodiment of the setting templates;

FIG. 21 shows a further alternative embodiment of the setting templates;

FIG. 22 shows an additional alternative embodiment of the setting templates;

FIG. 1 shows an apparatus for displaying characters, consisting of a basic part 1 and openings 2 in which slide elements 3 are held in a displaceable manner. Such an apparatus is already known from EP 1 232 491 A1 and is used for displaying prices for example, i.e. it is used as a price label.

Figure 2:
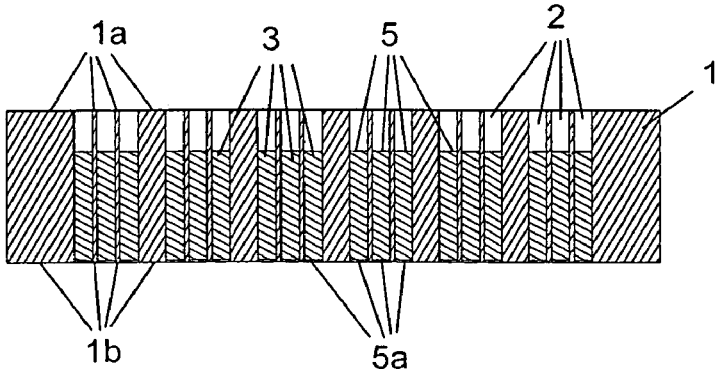
FIG. 2 shows a sectional view along the line XX of FIG. 1

FIG. 2 shows a sectional view along the line XX of FIG. 1. The slide elements can be moved from a position in which they are visible from the visible surface 1*a* of the basic part (direction of view 4 in FIG. 5) to a position in which they are not visible from the visible surface 1*a*.

A matrix of openings 2 is provided for each character to be displayed. In the present case this is a 3×5 matrix. The number of openings per character can be chosen at random.

Depending on the character to be displayed, the slide elements 3 are pushed to a position in which they are visible from the visible surface 1*a* (direction of view 4).

Figure 3:
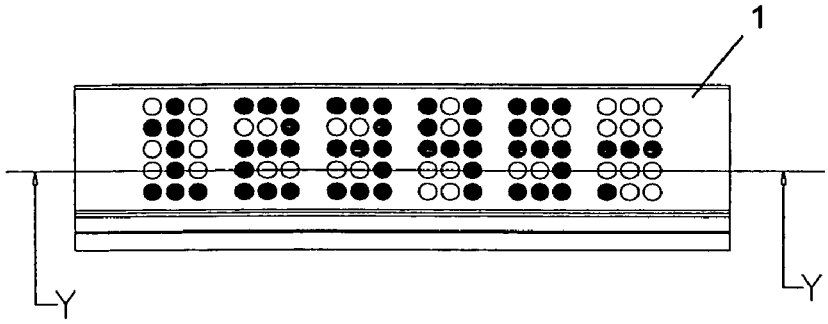
FIG. 3 shows a front view of a basic part with slide elements in a visible position.

FIG. 3 shows in an exemplary manner how the slide elements 3 are used for this purpose.

Figure 4:
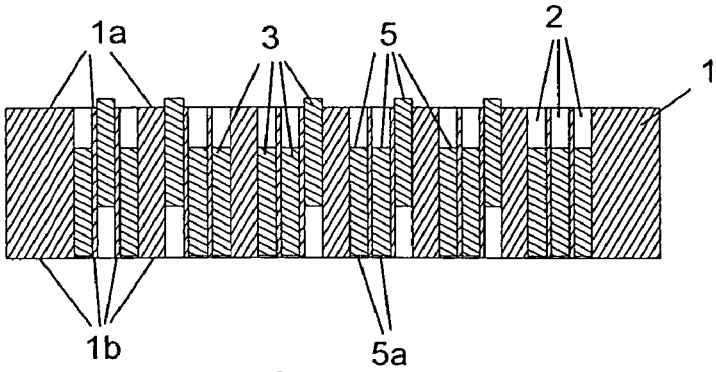
FIG. 4 shows a sectional view along the line YY of FIG. 3.

FIG. 4 shows the respective sectional view along line YY of FIG. 3, with the slide elements shown in FIG. 3 as a black dot projecting with their face surfaces 5 slightly over the visible surface 1*a* beyond the basic part 1 and thus being visible. It is understood that visibility is also ensured in the case when the face surfaces 5 are flush with the visible surface 1*a* and in the case of an arrangement of the face surfaces 5 within the basic part 1, shortly behind the visible surface 1*a*.

Figure 5:
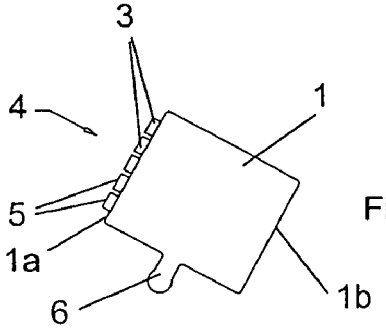
FIG. 5 shows a side view of a basic part.

FIG. 5 shows a side view of a basic part 1 with a web 6 which can be used for fastening to various holding apparatuses or for making the observation angle more convenient.

The apparatus in accordance with the invention is now used to adjust the slide elements 3 in such a way that the characters desired by the user can be displayed.

FIGS. 6 to 10 show such an apparatus in accordance with the invention in a side and sectional views.

The apparatus consists of two handle strips 7, 8 which are pivotably connected with each other. Setting templates 16 and 17 are arranged on the same. In the present embodiment, several setting templates 16, 17 are held parallel adjacent to one another and in a longitudinally displaceable manner in each handle strip 7, 8. As will be explained below in closer detail, alternative embodiments for the setting templates are possible.

The setting templates 16, 17 are provided with guide hooks 18 which engage in guide grooves 39 of the handle strips 7, 8 and are guided therein. The guide hooks 18 engaging in the handle strip 7 are simultaneously used as setting handles 11 whose purpose will be explained in closer detail in the course of describing the function.

Covers 10 are provided to cover the guide grooves 39 over the regions of the handle strips 7, 8, which prevents the intrusion of dirt.

The handle strips 7, 8 per se are compressible and are aligned in a V-shaped manner with respect to each other in their starting position. They are joined with each other via a pivoting apparatus 13. Notice must be taken here that the V-shaped starting position merely represents a preferred embodiment of the invention. The principal requirement is the compressibility, which can also be achieved for example by a parallel advancing movement. In the present embodiment, the pivoting apparatus 13 is a spring element which produces the V-shaped alignment in the starting position of the handle strips 7, 8 and is arranged in recesses 21 of the handle strips 7, 8. The spring element 13 is provided in its end regions with noses 20 which engage in respective stops 22 of the handle strips 7, 8 and fix the spring element 13.

The handle strip 7 is provided with a reading window 9 through which the adjustable characters 43 painted on the setting templates (cf. FIGS. 13 and 13*a*) can be read. Since the reading window 9 always faces the user, the handle strip 7 can also be designated as the upper handle strip and handle strip 8 as the lower handle strip.

Each of the setting templates 16 guided in the upper handle strip 7 is provided with a driver 14 which engages in a respective driving opening 15 of the setting template 17 guided directly opposite in the lower handle strip 8.

Positioning pins 34 for insertion into the openings 2 of the basic part are provided on each setting template 16, 17. It is also possible that several positioning pins are provided for one slide element 3. This is especially advantageous when a character is not formed by several slide elements which are movably held in the openings arranged in a matrix-like way, but when a character is formed merely by a larger slide element (as is shown in FIGS. 13*b*, 14*b* and 16*a*), which has the shape of the character per se for example. In this case, a positioning pin for said larger slide element would lead to the jamming of the same during the displacement.

In the present embodiment, the positioning pins 34 are arranged in groups in the setting templates (16, 17), with each group being separated from each other by webs 33. Groups which are directly opposite of one another on mutually opposite setting templates are associated with each other and are used for displaying a single character. The number of positioning pins 34 of such mutually associated groups thus corresponds in the present embodiment in total to the number of openings 2 of a matrix of a character to be displayed. By joining mutually opposite setting templates 16, 17 by means of driving pins 14 and the driving opening 15 it is ensured that the webs 33 of the mutually opposite setting templates 16, 17 are also aligned so as to be precisely directly opposite of each other and subsequently the groups of positioning pins 34. The webs 33 prevent the compression of the handle strips 7, 9 in case the setting templates 16, 17 are not correctly aligned to each other. This prevents a destruction of the positioning pins.

A holding element 52 is further arranged between the handle strips 7, 8, and especially between the setting templates 16, 17, which holding element is used to hold the apparatus for displaying the characters 1 and to fix the same relative to the positioning pins 34.

The holding element 52 is formed by several webs 41 which extend parallel with respect to each other, which are arranged at a distance from each other in which the setting templates 16, 17 are guided and which are mutually connected by means of a receiving means 23 which extends at a right angle thereto.

The webs 41 are provided with latches 42 which cooperate with latching grooves 44 arranged on the setting templates 16, 17 and allow the precise positioning of the positioning pins 34 relative to the basic part 1. The webs each further comprise a breakthrough 53 which substantially corresponds to the cross section of basic part 1. The breakthroughs 53 are aligned in a flush manner, so that a continuous opening is formed in the sliding direction of basic part 1. The receiving means 23 also comprises a breakthrough which is accessible from a side edge and with respect to its shape substantially corresponds to the longitudinal section of the basic part 1.

The respective outermost webs 41*a* of the holding element 52 are provided with a slightly thicker configuration and provided with a latching hook 45 which grasps behind recesses 46 in the handle strips 7, 8 and fixes the holding element 52 in a longitudinally displaceable manner between the two handle strips.

The receiver 23 divides the breakthroughs 53 of the webs 41 extending parallel with respect to each other into two halves, with the breakthrough being arranged in the intersecting region of the webs 41 with the receiving means 23, so that all breakthroughs jointly form within the holding element 52 an externally accessible, substantially cuboid chamber into which the basic part 1 can be slid.

FIG. 11 shows a sectional view along the line BB of FIG. 6. In this case too it can be clearly seen that each of the upper setting templates 16 is connected with one directly opposite lower setting template 17 via a driving pin 14. FIG. 11 also shows clearly how the setting templates are held in the handle strips 7, 8 via guide hooks 18.

FIG. 12 shows a sectional view along the line CC of FIG. 6. The free mobility of the setting templates 16, 17 is shown very clearly.

The apparatus in accordance with the invention works as follows:

A basic part 1, which is to be used for example for labeling goods or as a price label, is slid into the holding element 52. The apparatus in accordance with the invention is still in its initial position as shown in FIG. 9, 9*a*. The user must then predetermine the characters which are to be displayed on the basic part. This occurs by displacing the setting templates 16, 17 by means of the setting handles 11. The longitudinal displacement of the setting template 16 is transmitted via the driving pin 14 and the driving opening 15 onto the setting template 17. Mutually associated groups of positioning pins 34 are thus simultaneously displaced parallel with respect to each other. During the displacement of the setting templates 16, 17, one can read in the reading window 9 which character would be set on compressing the handle strips 7, 8 in the basic part and which positioning pins would be introduced into the basic part on compressing the handle strips.

Once the desired characters have been set (e.g. for the number 1.567 and the special character .–), the groups of positioning pins 34 which are required for theses characters are situated precisely above or below the basic part 1, as is still shown in FIGS. 9 and 9*a*.

In a next step, the handle strips 7, 8 are pressed together against the force of the spring element 13, as a result of which the positioning pins 34 of the setting templates 16, 17 are simultaneously introduced into the openings 2 from both sides of the basic part 1 and displace the slide elements 3 (cf. FIGS. 10 and 10*a*), with a group of positioning pins 34, e.g. the lower group in FIG. 10*a*, is responsible relating to each character to be displayed for the face sides 5 of the slide elements 3 which are visible from the visible surface 1*a* of the basic part 1, and the associated group of positioning pins 34 (e.g. the upper group in FIG. 10*a*) is responsible for the slide elements 3 which are not visible from the visible surface 1*a*. In the present embodiment, mutually associated groups of positioning pins 34 fill all openings 2 of a matrix for displaying a character.

After the handle strips 7, 8 have been brought back to their initial position (as shown in FIG. 9), the basic part 1 can be removed from the holding element 1.

In order to facilitate the removal of the basic part 1, an ejection mechanism is provided in the present embodiment. It consists of an ejector 24 which is displaceably held in the holding element 52 or, more precisely, in the receiving means 23 and which projects with a driving edge 29 into the breakthrough of the receiving means 23 and is pretensioned against the insertion movement of the basic part 1, preferably by means of a spring 25. Spring 25 rests on the one hand on the receiving means 23 and on the other hand on a pin 31 of the ejector 24 (cf. FIGS. 15*a* and 15*b*). The ejector 24 is provided with a guide groove 32 which slides along a guide web 35 extending on the receiving means 23.

By inserting the basic part 1 into the holding element 52, the ejector 24 is displaced over the driving edge 29 in the insertion direction against the force of a spring 25 until the movement is stopped by the ejector arresting device 30. An ejector hook 27 which is arranged on the ejector 24 on a tapering portion 28 is latched on a latching edge 37 of the holding element 52 which is opposite of the insertion opening 12 (or is latched more precisely in the outermost web 41*a*; cf. FIG. 18). During the setting process in which the handle strips 7, 8 are pressed against each other, the ejector hook 27 is lifted over the latching edge 37 again by an edge 38 of the lower handle strip 8, as a result of which the ejector 23 is moved by the spring 25 in the direction towards the insertion opening 12 of the holding element 52. As soon as the insertion opening 12 is released again, which opening was blocked in the course of the compression of the handle strips 7, 8 by their side surfaces 54*a,b* or by the positioning pins 34 stuck in the openings 2, the basic part 1 is moved by the ejector 24 from the chamber in the holding element 52 as a result of the relaxation of the spring 25. In order to prevent the basic part 1 from jumping out too quickly, a frictional surface 26 is provided on the ejector 24, which surface can be pressed against the basic part 1 and which does not block the ejection but brakes the ejection speed of the basic part 1 to such an extent that the same does not fall out of the holding element, but merely has enough kinetic energy in order to project out of the holding element 52 in order to then be manually taken therefrom.

FIGS. 20, 21 and 22 show alternative embodiments of the setting templates 16, 17. They are configured as elastic bands 50 or chain links 49 which are guided over deflection pulleys 47. The positioning pins 34 and preferably the webs 33 are arranged on the elastic bands 50 or the chain links 49. By turning the deflection rollers 47, the positioning pins 34 which are to be introduced into the openings 2 of the basic part 1 can be brought to the required position.

As an alternative thereto, the setting templates 16, 17 can also be arranged as polygonal or circular bodies 51 on which the positioning pins 34 are arranged.

Even in the case of alternative embodiments of the setting templates 16, 17, the adjustable characters 43 are painted or printed on the same.

The invention claimed is:

1. An apparatus for displacing slide elements (3) in an apparatus for displaying characters, preferably a price label, which consists of a basic part (1) comprising openings (2) for receiving the slide elements (3) and a visible surface (1*a*) and a reverse side opposite of a side, with the slide elements (3) being arranged in a displaceable manner from a first position in which a face side (5) of the slide elements (3) is visible from the visible surface (1*a*) of the basic part (1) to a second position in which the face surface (5) is arranged in the basic part (1) at a distance behind the visible surface (1*a*) and is substantially not visible, and with at least one opening being provided for displaying each character, with the at least one opening being preferably arranged in the form of a matrix in the case that there are several openings characterized in that two handle strips (7, 8) are provided which can be pressed against each other, are arranged in a preferably V-shaped manner, are joined in a pivotable way and on which there are arranged setting templates (16, 17) which are arranged opposite of each other and adjustable relative to each other and comprise positioning pins (34) which can be inserted into openings of the basic part (1), and that as a result of the movement towards each other of the handle strips (7, 8) the positioning pins (34) can be introduced from both sides into the openings (2) of the basic part (1) held between the handle strips (7, 8) and displace the slide elements (3) according to the characters to be displayed, with one or several positioning pins (34) being associated with each slide element (3) for each character to be displayed, which pins are all arranged on one of the setting templates (16, 17) and during each setting process each slide element (3) to be displaced is moved to its end position with a single displacement movement by said associated positioning pins (34).

2. An apparatus according to claim 1, characterized in that the setting templates (16, 17) are longitudinally displaceable in the handle strips (7, 8) and are held parallel and mutually opposite with respect to each other and the two mutually opposite setting templates (16, 17) are joined with each other and are fixed in their position relative to each other and groups of positioning pins (34) are arranged on the setting templates (16, 17) in mutually separated sections, with mutually directly opposite sections being associated with each other in the mutually joined setting templates (16, 17) and the groups of positioning pins (34) arranged in the mutually associated sections being provided for the simultaneous introduction into the openings (2) of the basic part (1).

3. An apparatus according to claim 2, characterized in that two mutually associated groups of positioning pins (34) jointly have the number of positioning pins (34) which corresponds to the number of openings (2) for displaying a character in the basic part (1), with one of the mutually associated groups of positioning pins (34) forming a positive image of the character on the one setting template (16) and the other group of mutually associated groups of positioning pins (34) forming an inverse representation of the character to be displayed on the other setting template (17).

4. An apparatus according to claim 1, characterized in that each handle strip (7, 8) comprises a guide groove (39) in which the setting templates (16, 17) are held.

5. An apparatus according to claim 4, characterized in that each setting template (16, 17) comprises guide hooks (18) which can be hooked into the guide grooves (39).

6. An apparatus according to claim 1, characterized in that the setting templates (16) guided on a handle strip (7, 8) are provided with a driving pin (14) which can be introduced into openings (15) of the setting templates (17) guided on the other handle strip (8).

7. An apparatus according to claim 1, characterized in that a holding element (52) is provided between the handle strips (7, 8) in which the basic part (1) can be introduced transversally to the direction of movement of the handle strips (7, 8).

8. An apparatus according to claim 7, characterized in that the holding element (52) consists of several webs (41) which are arranged at a distance and parallel with respect to each other, which are rectangular and which are joined to each other via a receiving means (23) extending at a right angle thereto.

9. An apparatus according to claim 8, characterized in that the distance of the webs (41) arranged mutually parallel with respect to each other corresponds substantially to the width of the setting templates (16, 17).

10. An apparatus according to claim 8, characterized in that each of the webs (41) arranged parallel with respect to each other comprises a breakthrough (53) and the breakthroughs (53) are in flush alignment and form a continuous opening into which the basic part (1) can be inserted, with the breakthroughs (53), as regards their shape, substantially corresponding to the cross section of the basic part (1).

11. An apparatus according to claim 8, characterized in that the receiving means (23) comprises a breakthrough which is accessible from a lateral edge and which with regard to its shape substantially corresponds to the longitudinal section of the basic part (1).

12. An apparatus according to claim 11, characterized in that the receiving means (23) divides the breakthroughs (53) of the webs (41) extending parallel with respect to each other into two halves and, in the intersecting region of the webs (41) with the receiving means (23), their breakthrough is arranged, so that all breakthroughs (53) jointly form within the holding element (52) an externally accessible, substantially cuboid chamber.

13. An apparatus according to claim 11, characterized in that an ejector (24) is provided which reaches into the web (41) that is arranged parallel with respect to each other, thus comprising a breakthrough of the receiving means (23) with a driving edge (29) and which is pre-tensioned preferably by means of a spring (25) against the insertion movement of the basic part (1).

14. An apparatus according to claim 13, characterized in that the ejector (24) comprises an ejector hook (27) which can be hooked into the receiving means (23).

15. An apparatus according to claim 13, characterized in that a frictional surface (26) is provided on the ejector (24) which can be pressed against the basic part (1) and which brakes the same during the ejection from the holding element (52).

16. An apparatus according to claim 8, characterized in that the setting templates (16, 17) are provided with latching grooves (44) which cooperate with the webs (41) of the holding element (52).

17. An apparatus according to claim 1, characterized in that the setting templates (16, 17) are chain links (49) which are guided over deflection pulleys (47) arranged in the handle strips (7, 8).

18. An apparatus according to claim 1, characterized in that the setting templates (16, 17) are elastic bands (50) which are guided over deflection pulleys (47) arranged in the handle strips (7, 8).

19. An apparatus according to claim 1, characterized in that the setting templates (16, 17) are rotatably held in the handle strips (7, 8) and are provided with a circular or polygonal configuration.

* * * * *